US006843676B2

(12) United States Patent
Lutsch et al.

(10) Patent No.: US 6,843,676 B2
(45) Date of Patent: Jan. 18, 2005

(54) MALE CONNECTOR WITH RETAINING ELEMENT

(75) Inventors: Harald Michael Lutsch, Weiterstadt (DE); Ranko Resman, Zagreb (HR); Dalibor Zorica, Zagreb (HR)

(73) Assignee: Yazaki Europe Ltd., Hertfordshire (GB)

( * ) Notice: Subject to any disclaimer, the term of this patent is extended or adjusted under 35 U.S.C. 154(b) by 0 days.

(21) Appl. No.: 10/656,177

(22) Filed: Sep. 8, 2003

(65) Prior Publication Data

US 2004/0082216 A1 Apr. 29, 2004

(30) Foreign Application Priority Data

Oct. 18, 2002 (DE) ..... 102 48 893

(51) Int. Cl.[7] ..... H01R 13/627
(52) U.S. Cl. ..... 439/352
(58) Field of Search ..... 639/372, 350, 639/352, 357, 489, 353, 354, 358

(56) References Cited

U.S. PATENT DOCUMENTS 5,066,244 A * 11/1991 Kato et al. ..... 439/489
5,201,670 A * 4/1993 Watanabe et al. ..... 439/372
6,102,726 A * 8/2000 Tsuji et al. ..... 439/352

FOREIGN PATENT DOCUMENTS

DE 197 54 876 A 6/1999
EP 1 280 242 A2 1/2003

* cited by examiner

*Primary Examiner*—Tho D. Ta
*Assistant Examiner*—X. Chung-Trans
(74) *Attorney, Agent, or Firm*—Sughrue Mion, PLLC

(57) ABSTRACT

The invention relates to a male connector 13 for connecting to a female connector, which female connector housing has on its outer face at least one retaining projection. The male connector 13 comprises a male connector housing 14 with an elastic locking arm 21 with a locking strut 23. The male connector 13 has a slider 29 arranged to, which is displaceably held on the male connector housing 14 in an axially limited way. In the locking position the slider 29 prevents a deflection of the locking arm 21 and releases the same in a position different thereto. Compression springs 27, supported on the male connector housing 14 and on the slider 29, act on the slider 29 for taking up its locking position. An elastic retaining element 35 made from round steel, is mounted on the slider 29. In the relaxed condition of the spring leg 37, the retaining element 35 contacts the end face 6 of the female connector housing. By means of abutting a releasing face of the male connector housing 14 the retaining element is brought out off contact to the end face of the female connector housing.

4 Claims, 4 Drawing Sheets

MALE CONNECTOR WITH RETAINING ELEMENT

DESCRIPTION

Figure 1:
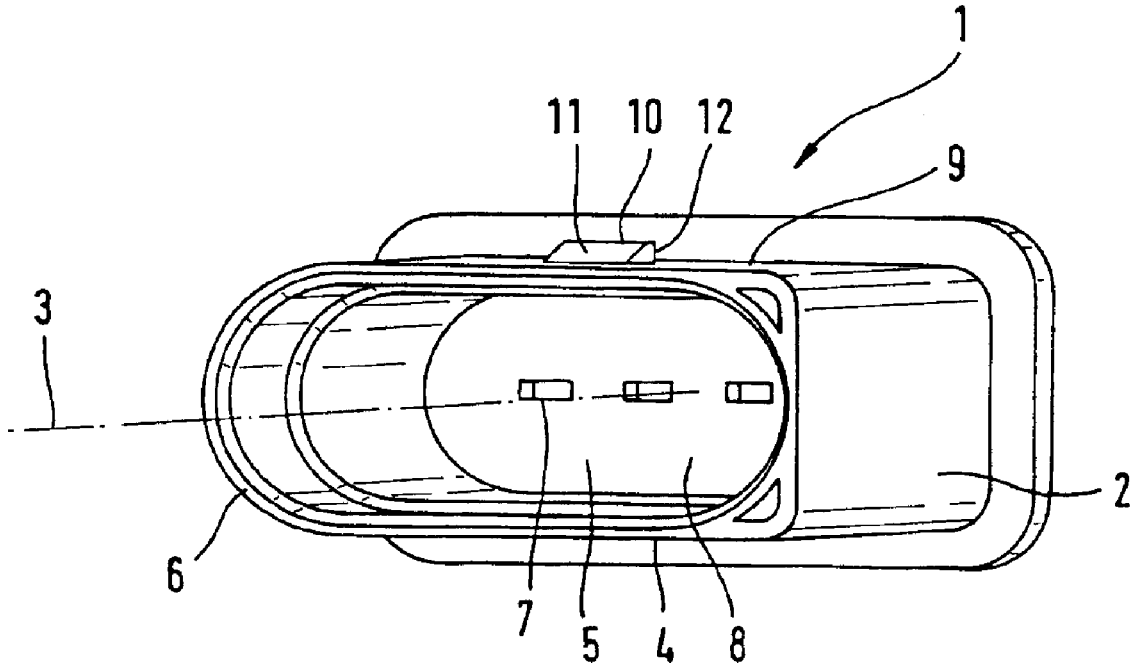

The invention relates to a male connector with a retaining element for connecting to a female connector. This is foreseen for the connection to a female connector, having a female connector housing with a first longitudinal axis and with an insertion chamber enclosed by a wall and open to an end face of the female connector housing and at the end distanced thereto, is closed by a base. First contacts, projecting into the insertion chamber from the base parallel to the first longitudinal axis, are arranged to the female connector housing. On the outer face of the wall enclosing the insertion chamber a retaining projection is projectingly provided. The retaining projection has an abutment face, which in a direction away from the end face towards the base, raises from the outer face, followed towards the base by a retaining face extending in a direction of the outer face.

EP 0 896 396 A2 describes a connector, comprising a female connector and a male connector. The female connector has a female connector housing and an insertion chamber enclosed by a wall. The insertion chamber is open towards one end face of the female connector housing and on its end distanced thereto is closed by a base. The female connector has a first longitudinal axis, defining a connection direction. First contacts are arranged to the female connector housing. The first contacts are aligned parallel to the first longitudinal axis and project from the base into the insertion chamber. On the outer face of the wall enclosing the insertion chamber a retaining projection is projectingly arranged. An elastically displaceable retaining arm, lockable by means of a slider, when it is arranged in the locking position and pre-vents, thereby, a displacement of the locking arm from the relaxed position, is arranged to the male connector. Compression springs are arranged to the slider, which are connected to each other at their ends, which are not supported on the slider, by a cross-bar. The locking arm has an inclined face, which, when inserting the male connector into the female connector, abuts the retaining projection. In this case, the slider is in a position, in which its retaining face is not in contact with the locking arm. For this, the locking arm is held by means of retaining means in a provisional (preliminary) position. When the male connector is inserted into the female connector, not only the locking arm with its hook-like projection abuts the retaining projection, but also the cross-bar, connecting the two compression springs, comes to abut the end face of the female connector. If the male connector is further inserted, the springs are loaded. The hook-like projection of the locking arm slides over and passed the retaining projection. Hereby, the locking arm has reached a position, in which its locking face is allowed to engage behind the retaining projection. Hereby, also the compression springs are released in their effect, i.e. the retaining means re-lease the slider, so that it is, because of the force of the springs, moved away from the retaining projection, whereby the retaining face of the slider gets above the locking arm and retains the same in its engagement position against displacement. Hereby, the retaining means are also brought back into their original position, so that also the springs are not loaded anymore. For releasing purposes, the slider has to be moved against the detaching direction of the male connector, so that the locking arm is released. To provide a sufficiently large contact area for the support of the compression springs, ribs, which are arranged in the prolongation of the extension of the compression springs, i.e. extend parallel to each other in the connection direction and extend from the end face of the female connector up to the retaining projection, are provided on the female connector housing.

For the detaching, the slider is, firstly, moved to that extent in the direction towards the female connector, that the locking arm is released. Hereby, the compression springs are partially pre-tensioned and the retaining means lock the slider in this position. In this position a detaching portion of the slider can be acted upon, i.e. can be pressed down, whereby this portion acts on a projection of the locking arm arranged therebelow. Thus as the locking arm is seesaw-like suspended, the hook-like projection is moved out off engagement to the retaining projection on the female connector. If the male connector is pulled, it can be separated from the female connector. This handling is cumbersome and necessitates especially then, when a safe operation is requested, additional measures in form of ribs on the female connector, to achieve a secure support for the compression springs, acting upon the slider. Disadvantageous is further the handling in-so-far as when releasing the connector, i.e. the male connector out off the female connector, the slider has to be initially moved against the releasing direction, to transfer the positioning slider into a position, in which by means of the operating portion belonging to the same, an application of a force onto the locking arm in the sense of releasing the same from the retaining projection of the female connector is possible. At the same time the male connector has to be pulled out, to detach the same from the female connector.

DE 198 28 968 A1 concerns a connector with a female connector and a male connector, wherein the female connector has a leaf spring-like retaining element, which serves at the same time as a short circuiting bar for the contacts of the female connector. The retaining element has two retaining legs, which, respectively, come into contact with a projection of the male connector and are deformed during the connection, so that the projections, respectively, can slide over a sharp bend in the retaining leg and thereafter allow a restoration, so that the male connector is secured in the female connector. Furthermore, two contact legs, contacting in the disconnected condition of the male connector with the female connector the contacts of the female connector, are provided, which form part of the retaining element, which is made from metal and is therefore, electrically conductive. Thus, in the detached condition a short circuiting contact is produced between the contacts via the contact legs. These are brought out off contact to the contacts of the female connector, when inserting the male connector.

DE 100 52 970 A1 describes a connector, comprising a female connector and a male connector, wherein to the male connector a slider is arranged, which is formed integrally with a compression spring and is initially loaded during the insertion and produces an expulsion force, as long as the final connection condition is not reached. This slider serves, furthermore, as a retaining element in the connected condition. The elastic portion formed as a compression spring comprises a serpent-like bent leaf spring-like portion.

EP 1 089 393 A1 describes a female connector with an insertion chamber, enclosed by a wall, into which a male connector can be inserted. To achieve a water-tight arrangement, the male connector has on the portion entering the insertion chamber of the female connector, a seal, contacting the inner face of the insertion chamber. The portion of the male connector, entering the insertion chamber of the female connector, is formed tapered in cross-section in reference to the area of the male connector off-set to the rear.

The invention is based on the object to propose a male connector for a common female connector, i.e. such a female connector, in which at least one retaining projection is provided, which is simple to operate and as long as no final connection is achieved, produces a force, which detaches the male connector from the female connector.

This object is solved by a male connector, comprising a male connector housing, having a second longitudinal axis, having a first housing portion, insertable into the insertion chamber, when the longitudinal axes are arranged parallel to each other, with an end face, from which second contacts, fitting to the first contacts and for connecting to the same are accessible, and having an elastically deflectable locking arm with locking means, arranged opposed to the locking projection when connecting to the female connector housing, a slider, held displaceable on the male connector housing along the second longitudinal axis between a releasing position and a locking position and preventing in the locking position a deflection of the locking arm, at least one compression spring, which on the one hand is supported on the male connector housing and on the other hand on the slider and acts onto the slider to take up its locking position, and an elastic retaining element, formed from steel wire, having two spring legs distanced to each other and extending from a connection portion and an attachment portion respectively attached to each spring leg in an angled manner, wherein each attachment portion engages in a separate insertion bore of the slider and wherein the insertion bores extend at a right angle to the second longitudinal axis and are parallel off-set to each other.

Of advantage in this embodiment is, that the male connector can be used in connection with common female connectors, which have at least one retaining projection, so that without changing the same it is ensured, that the male connector can be separated from the female connector as long as no final locking position has been reached. Furthermore, the operating is simplified in such a way, that during the connection it only has to be acted upon the male connector housing in such a way that this is moved relative to the female connector housing i.e. towards the base of the latter. The releasing of the slider for the final retainment of the locking arm is achieved automatically depending on the position of the male connector housing relative to the female connector housing, in that the leaf spring-like retaining element is brought out off working engagement to the end face of the female connector housing and therefore, the force of the compression springs acting between the male connector housing and the slider comes to act. The slider is displaced relative to the female connector housing and the male connector housing in such a way, that the locking arm is secured against displacement into the released position. This position can simply be released in such a way, that for the detaching of the male connector from the female connector it is acted upon the slider only in detaching direction. Furthermore, it is an important advantage, that the retaining element is a separate component, i.e. a component separated from the slider, made from a material, which practically shows no wear or set. By means of this layout of the retaining element in connection with the arrangement of the attachment portions in the off-setting insertion bores of the slider a compact design is achieved, as the attachment of the retaining element on the slider requires only a small space and can be used advantageously for the provision of the necessary spring path.

Preferably it is hereby provided the spring legs continue from the connection portion with a winding in such a way, that each spring leg leaves the connection portion by crossing same. Advantageous assembly conditions are produced in such a way, that the spring legs extend starting from the connection portion in such a way, that the attachment portions are off-set parallel to each other. Preferably the retaining element is formed from a round wire. Advantageous is also to produce it from stainless steel.

As the retaining element made from steel in the finally locking condition of the male connector with the female connector is elastically displaced from its normal position, i.e. as long as the female connector housing is connected to the male connector, is tensioned, it is advantageous, when it is manufactured from a stainless steel.

Figure 2:
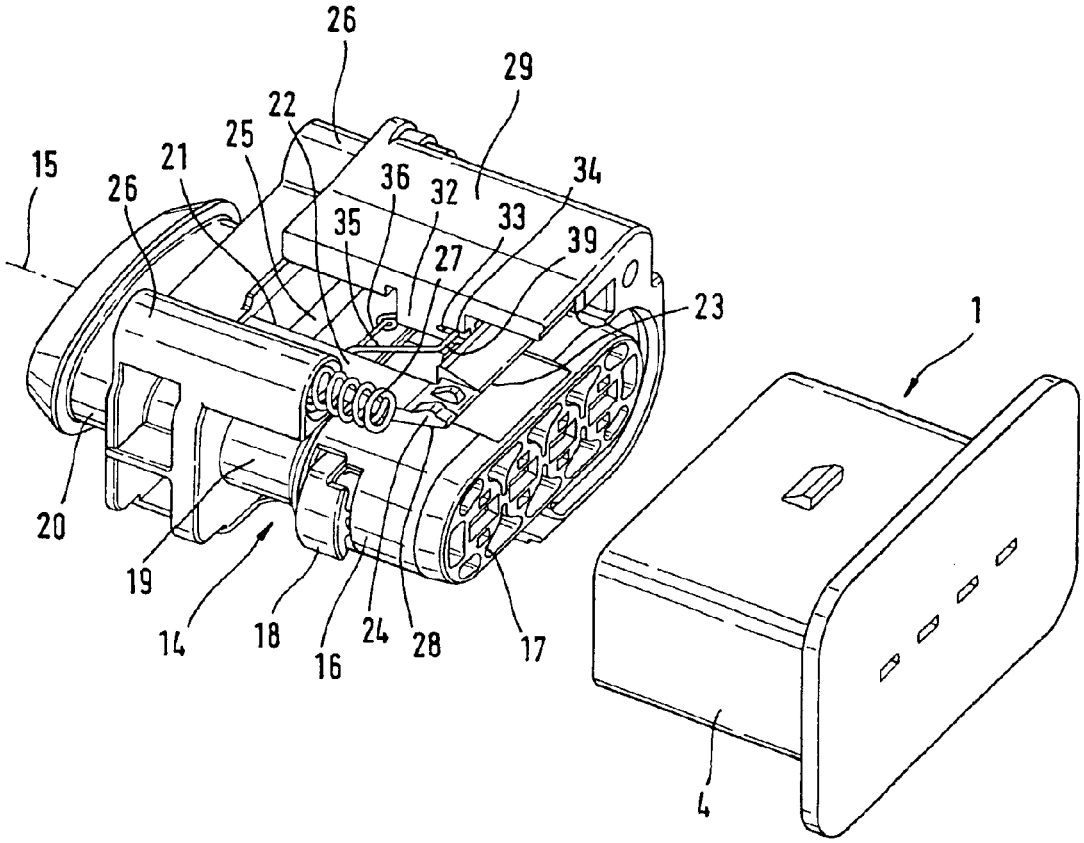
Figure 3:
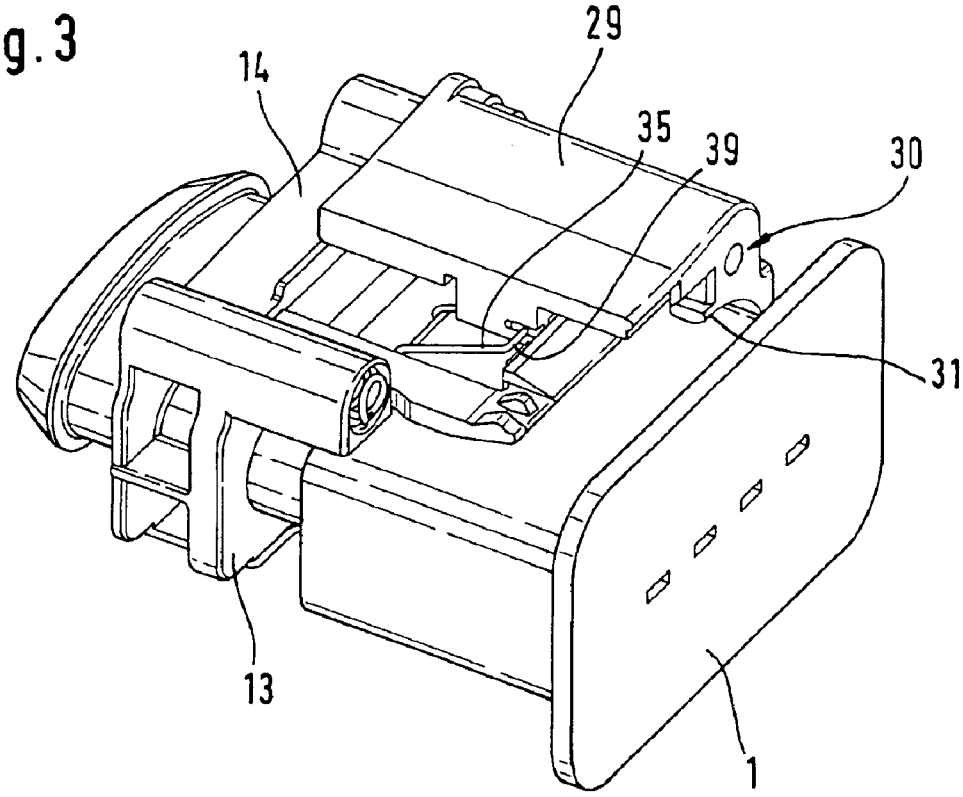
Figure 4:
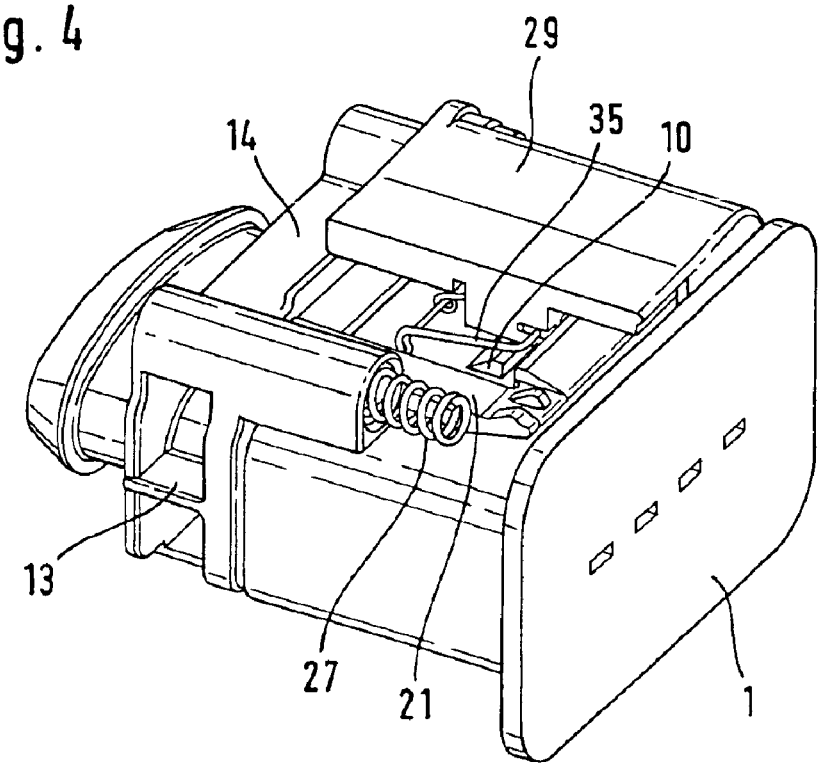
Figure 5:
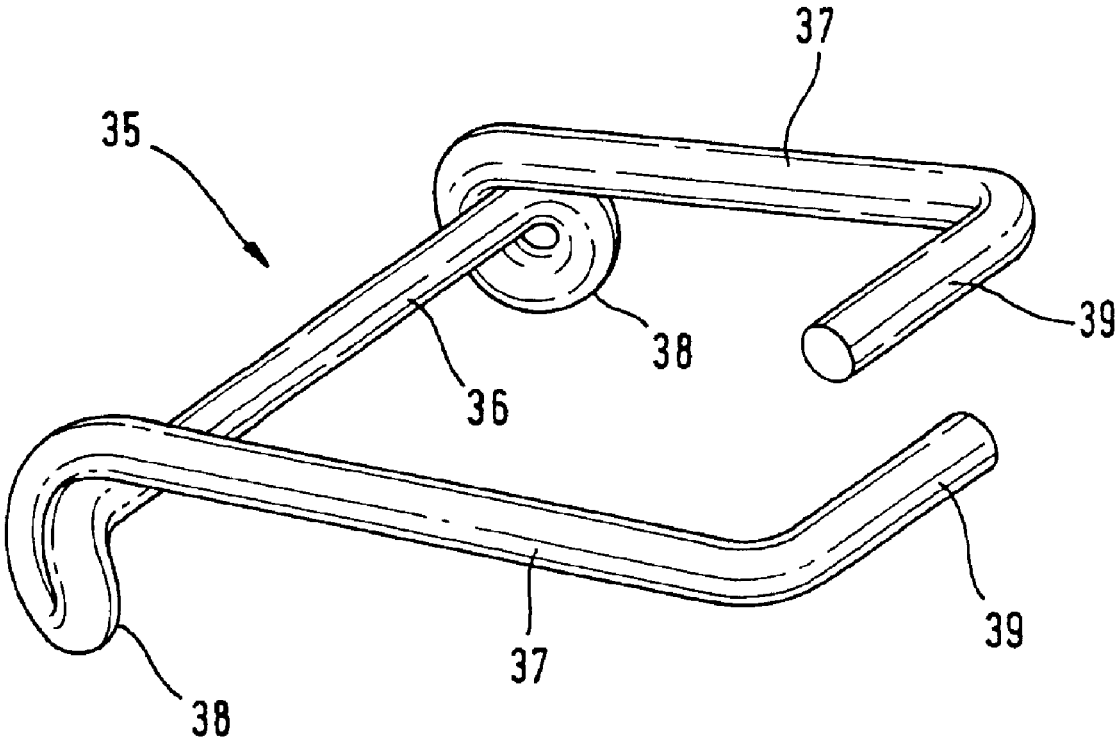

A preferred embodiment of the invention is schematically represented in the drawing, wherein FIG. 1 shows a perspective view of the female connector, FIG. 2 shows a perspective view of the male connector and the female connector before connecting the same, FIG. 3 shows a perspective view of the female connector with the male connector in a partially connected condition, FIG. 4 shows a perspective view of the male connector with the female connector in a completely connected condition, and FIG. 5 shows a perspective view of the retaining element.

In FIG. 1 a female connector 1 according to the State of the Art is shown. The female connector 1 comprises a female connector housing 2, which has a first longitudinal axis 3. It further has a wall 4, enclosing a rectangular insertion chamber 5 rounded-off in its opening cross-section. The insertion chamber is open to the end face 6 and is closed on the end, distanced thereto, by means of the base 8. The end face 6 is preferably provided with a chamfer towards the insertion chamber 5. From the base 8, first contacts 7 in form of pins project. They are aligned parallel to the first longitudinal axis 3. On an outer face 9 of the wall 4 a retaining projection 10 is arranged, which has an abutment face 11, which from its end facing the end face 6 raises in direction towards the base 8 and leaves the outer face 9. A retaining face 12, extending in the direction towards the outer face 9, i.e. extending preferably perpendicular thereto or if necessary also has an undercut, respectively, follows the retaining projection.

In FIG. 2 the male connector 13 is shown separated from the female connector 1 and has a male connector housing 14. The male connector housing 14 has the second longitudinal axis 15. It has a first housing portion 16, which, when connecting to the female connector 1, enters the insertion chamber 5 according to FIG. 1. For this the first longitudinal axis 3 and the second longitudinal axis 15 are aligned to each other. The first housing portion 16 extends from an end face 17, in which openings are provided, which communicate with the insertion chambers, into which second contacts in form of female connection terminals are inserted and are secured by means of a locking element 18.

The first housing portion 16 is followed by an intermediate portion 19 with a seat portion for a seal, reduced in cross-section, and a second housing portion 20. The cross-section of the first housing portion 16 is generally adapted to the cross-section of the insertion chamber 5 of the female connector housing 2 of the female connector 1, i.e. it approximates a rounded rectangular. On a wide face of the male connector housing 14, a locking arm 21 is arranged, which is formed like a frame and comprises two longitudinal struts 22, arranged parallel with a distance between each other and which with an end, distanced from the end face 17, are formed integrally with the male connector housing 14. The ends of the two longitudinal struts 22, close to the end face 17, are connected to each other by means of a transversally extending locking strut 23, serving as a locking means, which can be engaged for locking with the retaining projection 10 of the female connector 1.

Locking projections are arranged in the area of the end of the longitudinal struts 22 which is close to the locking projections 24. In the area opposite thereto, at least one re-leasing face 25, which away from the end face 17 departs from the second longitudinal axis 15, is arranged adjacent to the longitudinal struts 22. Furthermore, in this area lateral to the longitudinal struts 22 of the locking arm 21, two first spring sup-ports 26 are arranged, which support the compression springs 27 on one end. The locking strut 23 has on its lower side an adjustment face 28, which away from the first spring support 26 departs from the second longitudinal axis 15.

The male connector housing 14 is enclosed by a tubular slider 29. The slider has in its inner chamber, towards an end face, second spring supports 30, on which the compression springs 27 with their other end are supported. In the face opposed to the second spring supports a not represented adjustment recess is provided, which in the mounted condition of the slider 29 on the male connector housing 14 interacts with a not represented movement abutment of the male connector housing 14 and which abutment limits the movement of the slider 29 relative to the male connector housing 14 along the second longitudinal axis 15. Furthermore, on the slider 29, not represented locking abutments are provided, which in the completely connected condition of the female connector 1 with the male connector 13, retain the locking arm 21 on the female connector housing 2 against displacement, i.e. are arranged opposed to the locking projections 24.

To the slider 29, on the end having the second spring supports 30, two releasing projections 31 are arranged, which serve for releasing the locking arm 21 during the detaching of the male connector 13 from the female connector 1. When pulling at the slider 29, the locking arm 21 is elastically displaced from its relaxed position away from the second longitudinal axis 15 and moved towards the retaining projection 10 of the female connector 1, before the male connector housing 14 can be pulled out off the female connector housing 2. Furthermore, the slider 29 has a lug 32 with insertion bores 33, 34, extending transversally to the second longitudinal axis 15 and off-set parallel to each other.

A retaining element 35, as shown in FIG. 5, is arranged to the slider 29. The retaining element 35 consists of a round wire made from stainless steel.

Two spring legs 37 project transversally from a connection portion 36. They continue from the ends of the connection portion 36 with a winding 38, so that they leave transversally the connection portion 36. The end of each spring leg 37, distanced from the connection portion 36, is followed by an attachment portion 39, which is angled thereto. The attachment portions 39 extend parallel to the connection portion 36 and extend towards each other. The attachment portions 39 extend parallel to each other. The attachment portions 39 are received in the insertion bores 33, 34 of the lug 34 of the slider 29 as shown in FIG. 2, which insertion bores 33, 34 are off-set to each other. By means of this a counter-moment is produced when starting a pivoting movement in the area of the windings 38 or of the connection portion 36, respectively.

The compression springs 27 act on the slider 29 for taking up the position, shown in FIG. 2, on the male connector housing 14. The first housing portion 16 is inserted into the insertion chamber 5 of the female connector housing 2 with the first longitudinal axis 3 and the second longitudinal axis 15 aligned to each other. Due to this, the retaining element 35 together with the windings 38 or the connection portion 36, respectively, comes to rest against the end face 6 or the chamfer following this towards the insertion chamber 5 of the female connector 1. The retaining element 35 is in the relaxed condition. If the female connector 1 and the male connector 13 are further moved in connection direction (see FIG. 3), the slider 29 remains stationary in relation to the female connector 1, while the first housing portion 16 is moved deeper into the insertion chamber 5. At the same time, the locking arm 21 is released and can together with its locking strut 23 slide passed the abutment face 11 of the retaining projection 10, being elastically deformed at the same time and can engage behind the retaining face 12.

The end face of the slider 29 facing the female connector 1, is arranged not any more in a plane with the end face 17 of the housing portion 16, but is already close to the locking strut 23.

During this movement the first contact 7 is moved deeper into the first housing portion 16 of the male connector housing 14 below the windings 38 or the connection portion 37 of the retaining element 35, respectively, so that at the same time or when further inserting the male connector housing 14 into the insertion chamber 5 and during the approximation of the end face 17 towards the base 8 of the female connector housing 1, the retaining element 35 is deflected, so that its windings 38 are brought out off contact to the end face 6 of the female connector 1. The compression springs 27 loaded during the insertion of the male connector housing 14 into the female connector 1, can become active and displace the slider 29 relative to the male connector housing 14 in direction towards the base 8, whereby the retaining element 35 slides on the outer face 9 of the female connector 1. In this position the compression springs 27 are relaxed and the slider 29 is restored in relation to the male connector housing 14 into the position, shown in FIGS. 2 and 4, in which the locking arm 21 is secured against displacement away from the second longitudinal axis 15.

The movement of the retaining element 35 into the relaxed condition can be limited by an abutment on the lug 32 of the slider 29.

To detach the male connector 13 from the female connector 1, the slider 29 is moved away from the base 8, whereby the releasing projections 31 come under the adjustment face 28 of the locking arm 21 and lift the locking arm 21 out off engagement with the retaining projections 10.

Reference Numerals List

1 female connector
2 female connector housing
3 first longitudinal axis
4 wall
5 insertion chamber
6 end face
7 first contact
8 base
9 outer face
10 retaining projection

11 abutment face
12 retaining face
13 male connector
14 male connector housing
15 second longitudinal axis
16 first housing portion
17 end face
18 locking element
19 intermediate portion
20 second housing portion
21 locking arm
22 longitudinal strut
23 locking strut
24 locking projection
25 releasing face
26 spring support
27 compression spring
28 adjustment face
29 slider
30 second spring support
31 releasing projection
32 lug
33 insertion bore
34 insertion bore
35 retaining element
36 connection portion
37 spring leg
38 winding
39 attachment portion

What is claimed is:

1. A male connector (13) for connecting to a female connector (1), the female connector (1) having a female connector housing (2) with a first longitudinal axis (3) and an insertion chamber (5) enclosed by a wall (4) and open to an end face (6) of the female connector housing (2) and closed at the end, distanced thereto, by a base (8), to which first contacts (7) are arranged, projecting into the insertion chamber (5) from the base (8) and arranged parallel to the first longitudinal axis (3), wherein an outer face (9) of the wall (4) enclosing the insertion chamber (5) has at least one retaining projection (10), the male connector (13) comprising:

a male connector housing (14), having a second longitudinal axis (15), and including a first housing portion (16), insertable into the insertion chamber (5), when the longitudinal axes (3, 15) are arranged parallel to each other, with an end face (17), from which second contacts, mateable with the first contacts (7), are accessible, said male connector housing including an elastically deflectable locking arm (21) with locking means (23), opposing the retaining projection (10) when connecting to the female connector housing (2), a slider (29), held displaceable on the male connector housing (14) along the second longitudinal axis (15) between a releasing position and a locking position and preventing in the locking position a deflection of the locking arm (21), at least one compression spring (27), which is supported on the male connector housing (14) and on the slider (29) and acts on the slider (29) to take up its locking position, and an elastic retaining element (35), formed from steel wire, having two spring legs (37) distanced to each other and extending from a connection portion (36) and an attachment portion (39) respectively attached to each spring leg (37) in an angled manner, wherein each attachment portion (39) engages in a separate insertion bore (33, 34) of the slider (29) and wherein the insertion bores (33, 34) extend at a right angle to the second longitudinal axis (15) and are parallel off-set to each other.

2. The male connector according to claim 1, wherein the spring legs continue from the connection portion (36) with a winding (38) in such a way, that each spring leg (37) leaves the connection portion (36) by crossing same.

3. The male connector according to claim 1, wherein the spring legs (37) extend starting from the connection portion (36) in such a way, that the attachment portions (39) are off-set parallel to each other.

4. The male connector according to claim 1, wherein the retaining element (35) is made from a round wire.

* * * * *

UNITED STATES PATENT AND TRADEMARK OFFICE

CERTIFICATE OF CORRECTION

PATENT NO. : 6,843,676 B2 
DATED : January 18, 2005
INVENTOR(S) : Dipl.-Ing Harald Michael Lutsch et al.

It is certified that error appears in the above-identified patent and that said Letters Patent is hereby corrected as shown below:

Title page,
Item [30], Foreign Application Priorty Data, "102 48 893" should read
-- 102 48 893.2 --

Column 3,
Line 65, delete "clement", insert -- element --.

Signed and Sealed this

Sixteenth Day of August, 2005

JON W. DUDAS
*Director of the United States Patent and Trademark Office*